US008567368B2

(12) United States Patent
Tsubakino et al.

(10) Patent No.: US 8,567,368 B2
(45) Date of Patent: Oct. 29, 2013

(54) CYLINDER HEAD STRUCTURE IN FOUR-CYCLE ENGINE

(75) Inventors: Yukihiro Tsubakino, Saitama (JP); Shinsuke Yasui, Saitama (JP); Isao Azumagakito, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 1089 days.

(21) Appl. No.: 12/395,154

(22) Filed: Feb. 27, 2009

(65) Prior Publication Data

US 2009/0241891 A1 Oct. 1, 2009

(30) Foreign Application Priority Data

Mar. 31, 2008 (JP) ..... 2008-092716

(51) Int. Cl.
*F02F 1/42* (2006.01)

(52) U.S. Cl.
USPC ..... 123/193.5; 123/90.39; 123/90.4; 123/90.41; 123/90.42; 123/90.43; 123/90.44; 123/90.45; 123/90.46; 123/90.47

(58) Field of Classification Search
USPC ..... 123/193.5, 90.39–90.47
See application file for complete search history.

(56) References Cited

U.S. PATENT DOCUMENTS 4,438,735 A 3/1984 Burandt
4,682,575 A * 7/1987 Simko ..... 123/90.44
4,858,573 A * 8/1989 Bothwell ..... 123/90.15
4,961,407 A * 10/1990 McWhirter ..... 123/90.41
5,148,781 A * 9/1992 Piatti ..... 123/193.5
5,987,973 A * 11/1999 Fujii et al. ..... 73/114.28
6,205,966 B1 * 3/2001 Breitenberger ..... 123/90.23
6,453,861 B1 * 9/2002 Nomura et al. ..... 123/90.23
6,948,470 B2 * 9/2005 Tsutsumi et al. ..... 123/193.5
7,673,609 B2 * 3/2010 Inui et al. ..... 123/193.5
7,934,480 B2 * 5/2011 Katayama et al. ..... 123/90.37
2007/0283912 A1 * 12/2007 Reinhart et al. ..... 123/90.34

FOREIGN PATENT DOCUMENTS

JP 57-200648 A 12/1982
JP 4-505358 A 9/1992
JP 2004-100651 A 4/2004
WO 90/15916 A1 12/1990

* cited by examiner

*Primary Examiner* — Marguerite McMahon
*Assistant Examiner* — James Kim
(74) *Attorney, Agent, or Firm* — Birch, Stewart, Kolasch & Birch, LLP

(57) ABSTRACT

To achieve further reduction in size and weight of a cylinder head in a four-cycle engine having a connection surface formed on the cylinder head to connect a head cover set so as to follow along a plane that is inclined so as to be spaced further away from a cylinder block toward a first side wall. A camshaft holder is integrally formed on a cylinder head so as to protrude from a connection surface as viewed from an axial direction of a camshaft. An intake port is disposed in the first side wall such that an upstream end thereof is disposed at the same position as part of the bearing portion in a direction along an axis of a cylinder bore. An exhaust valve has a stem end disposed at a position protruding from the connection surface as viewed in a direction along the axial direction of a camshaft.

15 Claims, 7 Drawing Sheets

CYLINDER HEAD STRUCTURE IN FOUR-CYCLE ENGINE

CROSS-REFERENCE TO RELATED APPLICATIONS

This application claims priority under 35 U.S.C. §119(a) to Application No. 2008-092716, filed in Japan on Mar. 31, 2008, the entirety of which is expressly incorporated herein by reference.

BACKGROUND OF THE INVENTION

1. Field of the Invention

The present invention relates in general to a four-cycle engine including a cylinder block having a cylinder bore in which a piston can be slidably fitted. A cylinder head is connected to the cylinder block, the cylinder head forming a combustion chamber that faces a top of the piston in a space defined by the cylinder head and the cylinder block. A camshaft is disposed on an extension of an open/close operation axis of an intake valve, the camshaft forming part of a valve actuating system driving to open and close the intake valve and an exhaust valve openably disposed in the cylinder head. An intake port is disposed in a first side wall extending along an axis of the camshaft so as to be disposed in the cylinder head. An exhaust port is disposed in a second side wall disposed in the cylinder head so as to oppose the first side wall. A head cover forms a valve train chamber that accommodates therein the valve actuating system in a space defined by the head cover and the cylinder head. A connection surface formed in the cylinder head for connecting the head cover is extended to follow along a plane that is inclined so as to be spaced further away from the cylinder block toward the first side wall relative to the second side wall. More particularly, the present invention relates to an improved cylinder head structure.

2. Description of Background Art

A known four-cycle engine, as disclosed in Japanese Patent Laid-Open No. 2004-100651 for example, has an arrangement for contributing to an even more compact cylinder head, in which a connection surface between the cylinder head and the head cover is set so as to extend along a plane that obliquely crosses a cylinder axis.

The arrangement disclosed in Japanese Patent Laid-Open No. 2004-100651 has the connection surface between the cylinder head and the head cover inclined obliquely relative to the cylinder axis, which helps make the cylinder head more compact. Stem ends of the intake valve and the exhaust valve are; however, disposed on the side of the cylinder block relative to the connection surface as viewed from the axial direction of the camshaft. This leaves room for even further reduction in size and weight of the cylinder head.

SUMMARY OF THE INVENTION

The present invention has been made to address this problem and it is an object of the present invention to provide a cylinder head structure in a four-cycle engine that enables further reduction in size and weight of the cylinder head.

To achieve the foregoing object, a cylinder head structure according to a first aspect of the present invention is for a four-cycle engine, the four-cycle engine including a cylinder block having a cylinder bore in which a piston can be slidably fitted; a cylinder head connected to the cylinder block, the cylinder head forming a combustion chamber that faces a top of the piston in a space defined by the cylinder head and the cylinder block; a camshaft disposed on an extension of an open/close operation axis of an intake valve, the camshaft forming part of a valve actuating system driving to open and close the intake valve and an exhaust valve openably disposed in the cylinder head; an intake port disposed in a first side wall extending along an axis of the camshaft so as to be disposed in the cylinder head; an exhaust port disposed in a second side wall disposed in the cylinder head so as to oppose the first side wall; and a head cover forming a valve train chamber that accommodates therein the valve actuating system in a space defined by the head cover and the cylinder head, a connection surface formed in the cylinder head for connecting the head cover being extended to follow along a plane that is inclined so as to be spaced further away from the cylinder block toward the first side wall relative to the second side wall.

In the four-cycle engine having the foregoing arrangements, camshaft holders having semi-circular bearing portions that receive a substantially half portion of the camshaft to be integrally connected to the first side wall are integrated with the cylinder head in a protruding condition at a position protruding from the connection surface as viewed from an axial direction of the camshaft. The intake port is disposed in the first side wall such that an upstream end thereof is disposed at a position identical to part of the bearing portions in a direction along an axis of the cylinder bore. Furthermore, a stem end of the exhaust valve is disposed at a position protruding from the connection surface as viewed in a direction along the axis of the camshaft.

According to a second aspect of the present invention, in addition to the arrangements of the first aspect of the present invention, the valve actuating system includes a rocker shaft having an axis extending in parallel with the camshaft and supported by the cylinder head by being disposed at a position protruding from the connection surface as viewed from the axial direction of the camshaft. A rocker arm is rotatably supported by the rocker shaft so as to rockably follow rotation of an exhaust-side valve actuating cam disposed on the camshaft. Furthermore, the stem of the exhaust valve driven to open or close by the rocker arm is shorter in length than a stem of the intake valve.

According to a third aspect of the present invention, in addition to the arrangements of the first or second aspect of the present invention, the bearing portions of the camshaft holders are disposed at positions protruding from the connection surface as viewed from the axial direction of the camshaft.

In accordance with the first aspect of the present invention, the intake port is disposed at the first side wall of the cylinder head and the exhaust port is disposed at the second side wall disposed at the cylinder head, the second side wall facing the first side wall. Furthermore, the connection surface formed in the cylinder head for connecting the head cover is set to follow along the plane that is inclined so as to be spaced further away from the cylinder block toward the first side wall relative to the second side wall. In addition, the camshaft holders having the semi-circular bearing portions that receive the substantially half portion of the camshaft and the stem end of the exhaust valve protrude from the connection surface as viewed from the axial direction of the camshaft. The foregoing arrangements permit further reduction in size and weight of the cylinder head. In addition, the intake port is disposed in the first side wall such that the upstream end thereof is disposed at a position identical to part of the bearing portions of the camshaft holders in the direction along the axis of the cylinder bore. A flow direction in the intake port is sharply inclined at a side close to the cylinder axis, thereby ensuring good introduction of fuel into the combustion chamber for the enhanced engine performance in a low-to-medium speed range. Moreover, the camshaft holders are integrally connected with the first side wall to be integrated with the cylinder head in a protruding condition. Stiffness of the camshaft holders can therefore be enhanced such that the camshaft holders are reinforced with the first side wall.

In accordance with the second aspect of the present invention, the stem of the exhaust valve is shorter in length than the stem of the intake valve. This allows the exhaust valve to be reduced in weight for the improved operating response of the exhaust valve at a high speed range. The stem end of the exhaust valve is disposed at a position protruding from the connection surface despite the shorter length of the stem of the exhaust valve. This allows a tappet clearance between the rocker arm and the stem end be checked easily.

In accordance with the third aspect of the present invention, the bearing portions of the camshaft holders are disposed at positions protruding from the connection surface as viewed from the axial direction of the camshaft. Machinability of the bearing portions can therefore be improved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
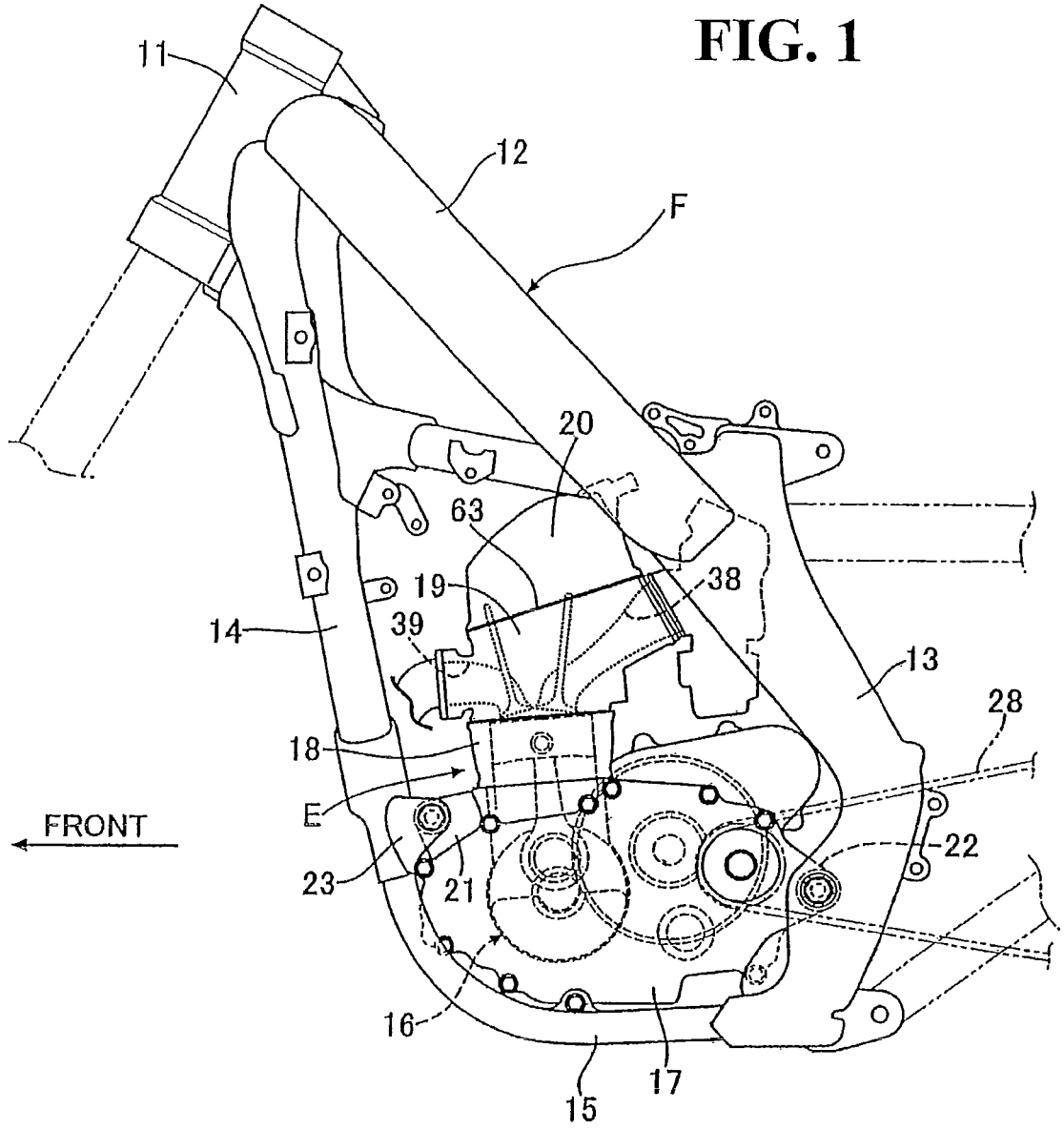
FIG. 1 is a side elevational view showing a four-cycle engine mounted in a vehicle body frame of a motorcycle.

The present invention will now be described with reference to the accompanying drawings, wherein the same reference numerals have been used to identify the same or similar elements throughout the several views.

FIGS. 1 to 10 show an embodiment of the present invention. Referring first to FIG. 1, a cradle type vehicle body frame F for a motorcycle includes a head pipe 11, a main frame 12, a pivot plate 13, a down frame 14, and a lower frame 15. Specifically, the main frame 12 extends downwardly from the head pipe 11 toward the rear. The pivot plate 13 extends downwardly and is connected in a row arrangement to a rear portion of the main frame 12. The down frame 14 is connected in a row arrangement to the head pipe 11 so as to extend downwardly toward the rear at an angle more acute than the main frame 12. The lower frame 15 extends rearwardly and is connected to a lower portion of the down frame 14. The lower frame 15 is then connected to a lower portion of the pivot plate 13. A single-cylinder, four-cycle engine E is mounted in the vehicle body frame F.

Figure 2:
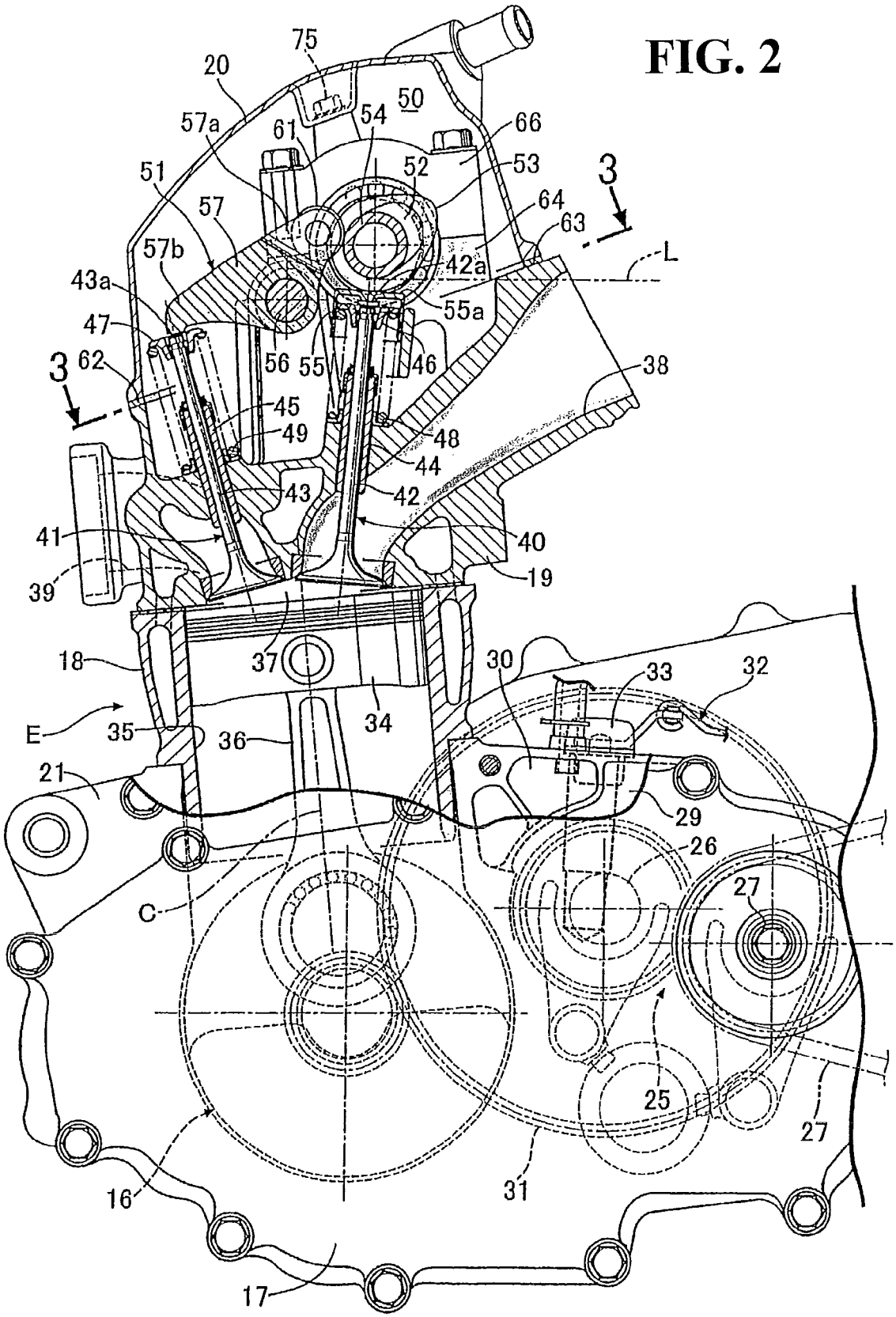
FIG. 2 is a partly cutaway, enlarged side elevational view showing the four-cycle engine as viewed from the same direction as in FIG. 1, partly cut away along line 2-2 of FIG. 3.

Referring also to FIG. 2, the four-cycle engine E includes a crankcase 17, a cylinder block 18, a cylinder head 19, and a head cover 20. The crankcase 17 rotatably supports a crankshaft 16 having an axis extending in a width direction of the motorcycle. The cylinder block 18 extends upwardly and is connected to a front upper portion of the crankcase 17. The cylinder head 19 is connected to an upper portion of the cylinder block 18. The head cover 20 is connected to an upper portion of the cylinder head 19. A support portion 21 disposed at a front portion of the crankcase 17 is fastened to a bracket 23 disposed at a joint between the down frame 14 and the lower frame 15. A support portion 22 disposed at a rear of the crankcase 17 is fastened to the pivot plate 13.

A transmission 25 is built into a rear portion of the crankcase 17. Specifically, the transmission 25 includes a gear train of a plurality of shift speeds to be selectively established between a main shaft 26, to which power is transmitted from the crankshaft 16, and a countershaft 27 that can transmit power to the side of a rear wheel not shown via an endless chain 28.

A breather chamber 30 is formed at an upper portion of the crankcase 17 on the side of the cylinder block 18. The breather chamber 30 communicates with a transmission chamber 29 formed inside the crankcase 17 so as to accommodate therein the transmission 25. In addition, a clutch operation mechanism 32 and a cap 33 are disposed in the crankcase 17 so as to overlap the breather chamber 30 as viewed from a direction extending along the axis of the crankshaft 16. The clutch operation mechanism 32 connects or disconnects a clutch 31 disposed coaxially with the main shaft 26 so as to be inserted between the crankshaft 16 and the main shaft 26. The cap 33 openably closes a filler port through which oil is poured into the transmission chamber 29. The foregoing positional arrangements of the breather chamber 30, the clutch operation mechanism 32, and the cap 33 make for greater workability in pouring the oil in the transmission chamber 29, while achieving reduction in size of the engine E.

The cylinder block 18 has a cylinder bore 35 formed therein in which a piston 34 can be slidably fitted. The piston 34 is connected to the crankshaft 16 via a connecting rod 36. In addition, a combustion chamber 37 facing a top of the piston 34 is formed between the cylinder block 18 and the cylinder head 19. A single intake port 38 to be brought into communication with the combustion chamber 37 and a single exhaust port 39 to be brought into communication with the combustion chamber 37 are disposed in the cylinder head 19.

A pair of intake valves 40 and a pair of exhaust valves 41 are openably disposed in the cylinder head 19. The pair of intake valves 40 opens or closes a path between the combustion chamber 37 and the intake port 38. The pair of exhaust valves 41 opens or closes a path between the combustion chamber 37 and the exhaust port 39. Stems 42, 43 included in the intake valves 40 and the exhaust valves 41, respectively, are slidably fitted into guide tubes 44, 45 disposed in the cylinder head 19. Valve springs 48, 49 are disposed between retainers 46, 47 disposed at stem ends 42*a*, 43*a* of the stems 42, 43, respectively and cylinder head 19. Spring forces exerted by the valve springs 48, 49 urge the intake valves 40 and the exhaust valves 41 in valve closing directions, respectively.

Figure 3:
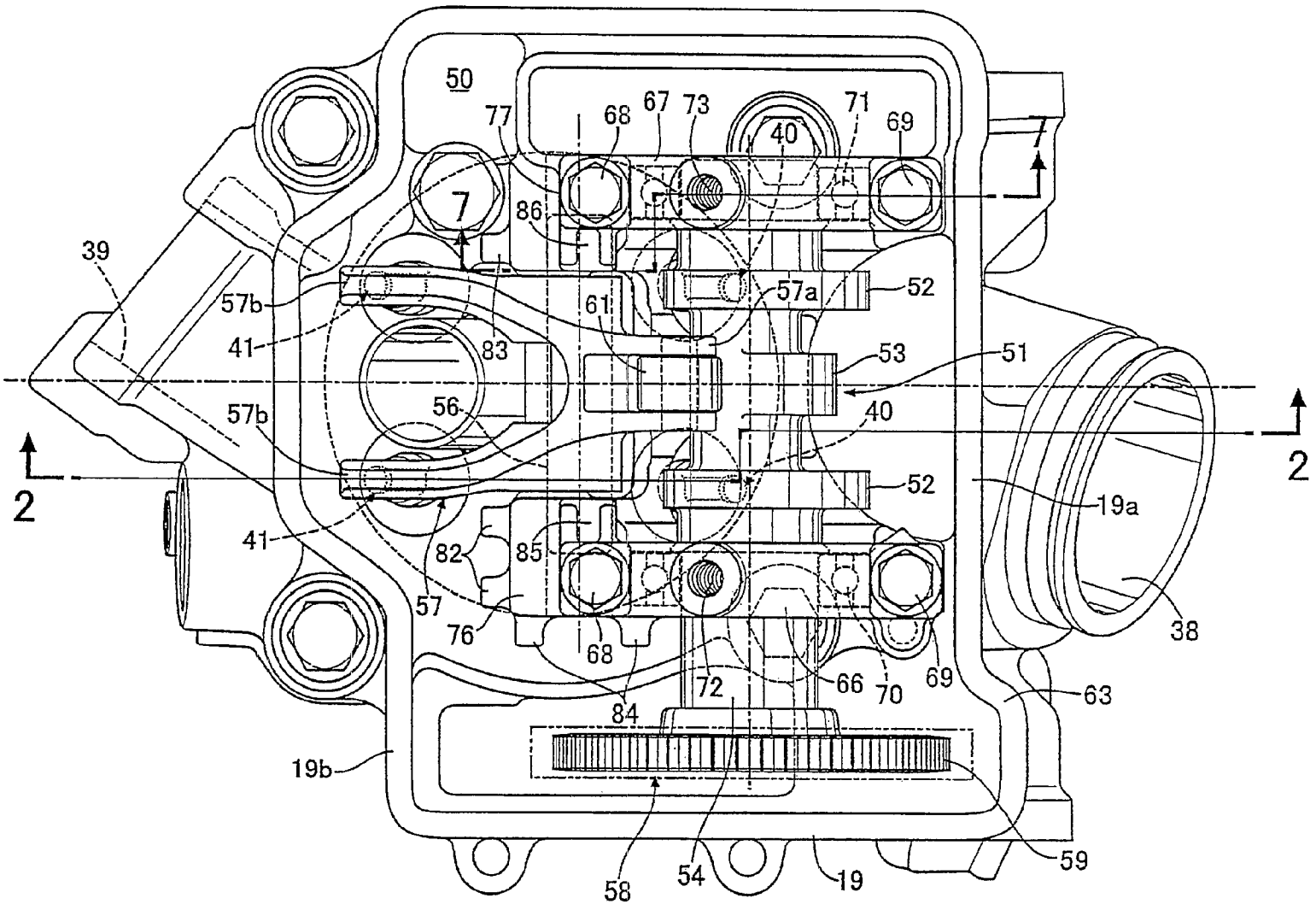
FIG. 3 is a plan view showing a cylinder head as viewed on arrows of line 3-3 of FIG. 2.

Referring also to FIG. 3, the intake valves 40 and the exhaust valves 41 are driven to open or close by a valve actuating system 51 accommodated in a valve train chamber 50 formed between the cylinder head 19 and the head cover 20. The valve actuating system 51 includes a camshaft 54, a pair of valve lifters 55, and a rocker arm 57. The camshaft 54 has an axis that extends in parallel with the crankshaft 16. Further, the camshaft 54 includes a pair of intake-side valve actuating cams 52, 52 and a single exhaust-side valve actuating cam 53. The pair of valve lifters 55 is fitted slidably into the cylinder head 19 to intervene between the two intake-side valve actuating cams 52 and the two intake valves 40. The rocker arm 57 is disposed between the exhaust-side valve actuating cam 53 and the exhaust valves 41 and is rockably supported by a rocker shaft 56 having an axis that extends in parallel with the camshaft 54.

The camshaft 54 is disposed on an extension from an open/close operation axis of the intake valves 40, specifically, an axis of the stems 42. The camshaft 54 has a first end to which a driven sprocket 59 is fixed. The driven sprocket 59 forms part of a timing transmission means 58 for transmitting a rotatable power from the crankshaft 16 to the camshaft 54 at a reduction ratio of 1/2. Each of the valve lifters 55 is formed into a cylindrical shape with a bottom having on one end thereof an end wall 55*a*, an outer surface of which makes a sliding contact with a corresponding one of the intake-side valve actuating cams 52, 52. The valve lifter 55 is fitted into the cylinder head 19, while being slidable along the open/close operation axis of the intake valve 40. Each of the stem ends 42*a* of the intake valves 40 abuts against an inner surface of a corresponding one of the end wall 55*a* of the valve lifters 55.

The rocker arm 57 integrates a cam abutment portion 57*a* and a pair of valve abutment portions 57*b*, 57*b*. The cam abutment portion 57*a* rotatably journals a roller 61 that makes rolling contact with the exhaust-side valve actuating cam 53. The pair of valve abutment portions 57*b*, 57*b* is bifurcated from the cam abutment portion 57*a* such that each of the valve abutment portions 57*b*, 57*b* abuts on a corresponding one of the stem ends 43*a* of the exhaust valves 41. The rocker arm 57 is thus rockably journaled by the rocker shaft 56 disposed between the exhaust valves 41 and the camshaft 54.

Figure 4:
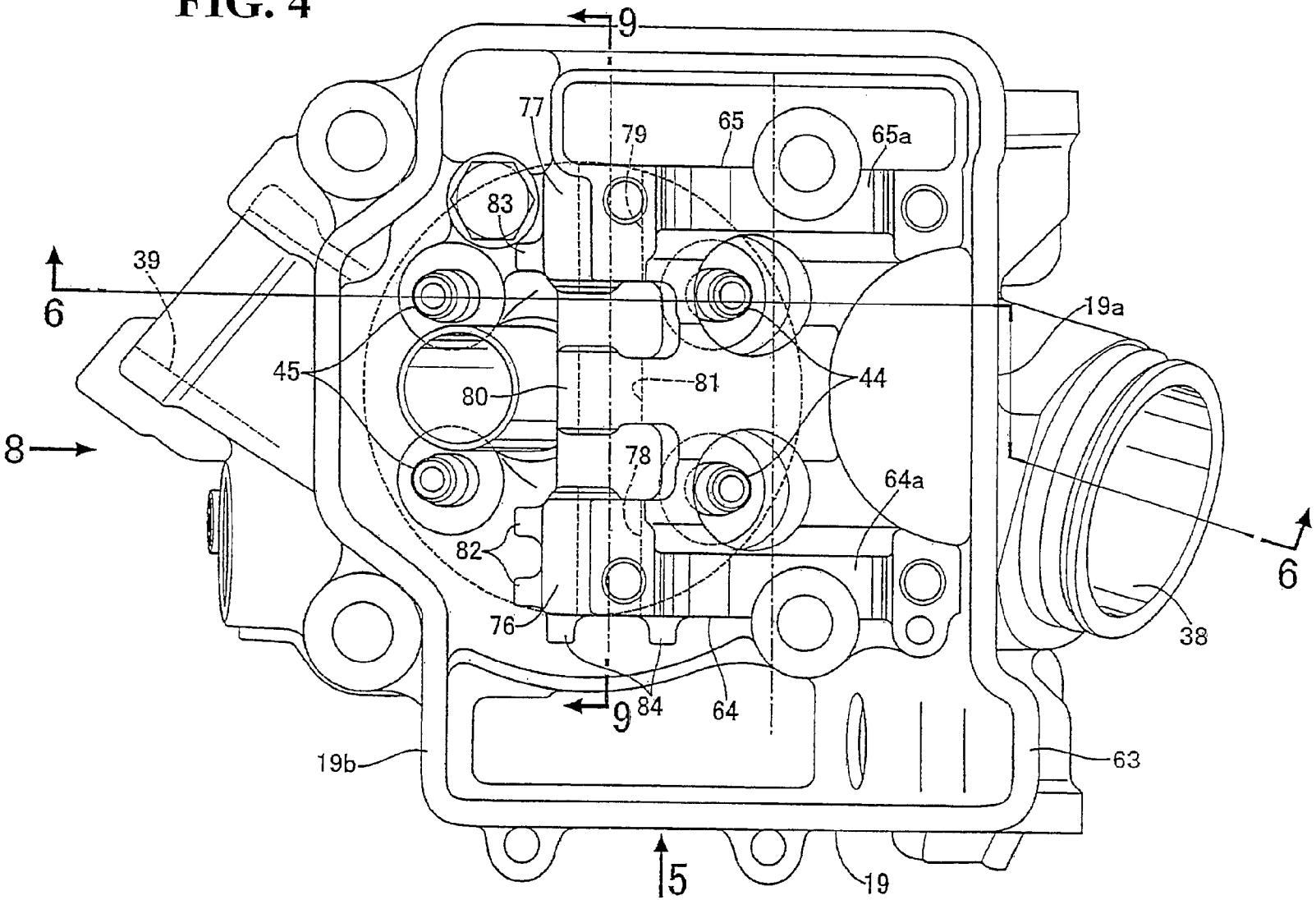
FIG. 4 is a plan view showing the cylinder head of FIG. 3 with a camshaft, a rocker arm, and a rocker shaft omitted.
Figure 5:
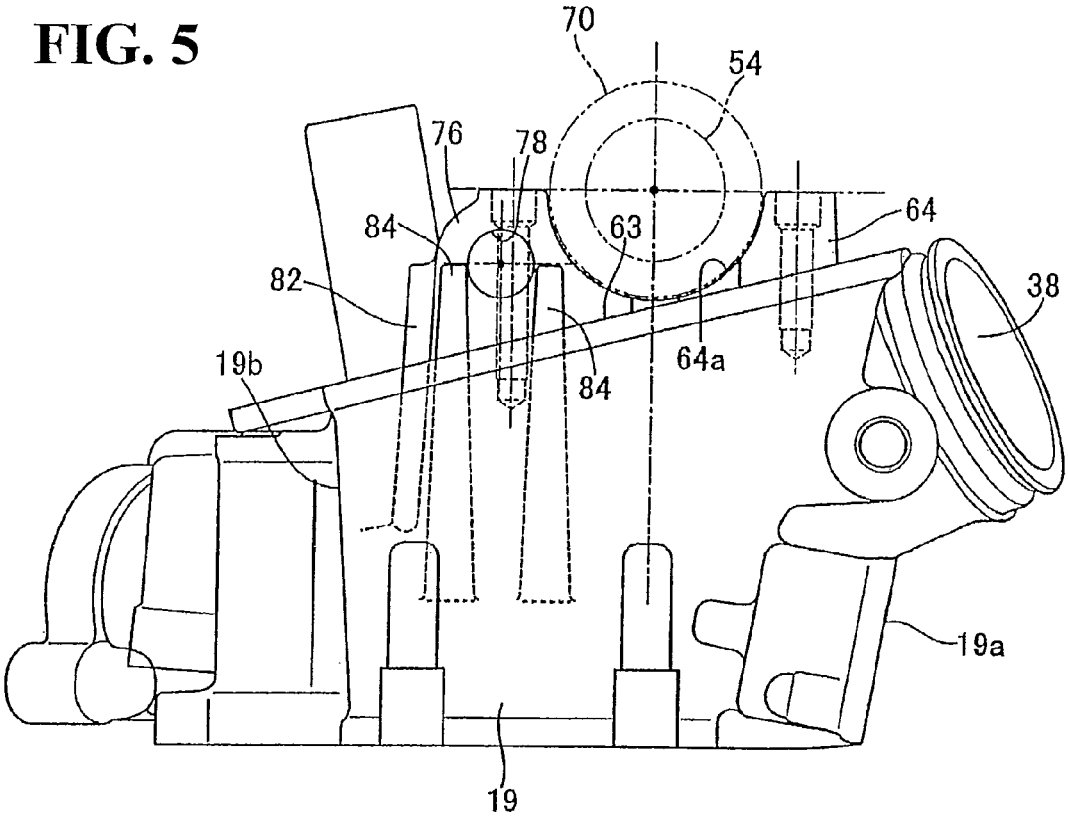
FIG. 5 is a view on arrow 5 of FIG. 4.

Referring also to FIGS. 4 and 5, the cylinder head 19 includes first and second side walls 19*a*, 19*b*, each extending in a direction along the axis of the camshaft 54 and mutually opposing each other. The intake port 38 is disposed in the first side wall 19*a*. The exhaust port 39 is disposed in the second side wall 19*b*.

Note also that the head cover 20 is connected to an upper end of the cylinder head 19 via a gasket 62. A connection surface 63 for connecting the head cover 20 is formed on the upper end of the cylinder head 19. The connection surface 63 is set so as to follow along a plane inclined to be spaced further away from the cylinder block 18 toward the first side wall 19*a* relative to the second side wall 19*b*.

Moreover, the stem ends 43*a* of the exhaust valves 41 are disposed at positions protruding from the connection surface 63 as viewed in a direction along the axis of the camshaft 54. Further, the stems 43 of the exhaust valves 41 are shorter in length than the stems 42 of the intake valves 40.

Figure 6:
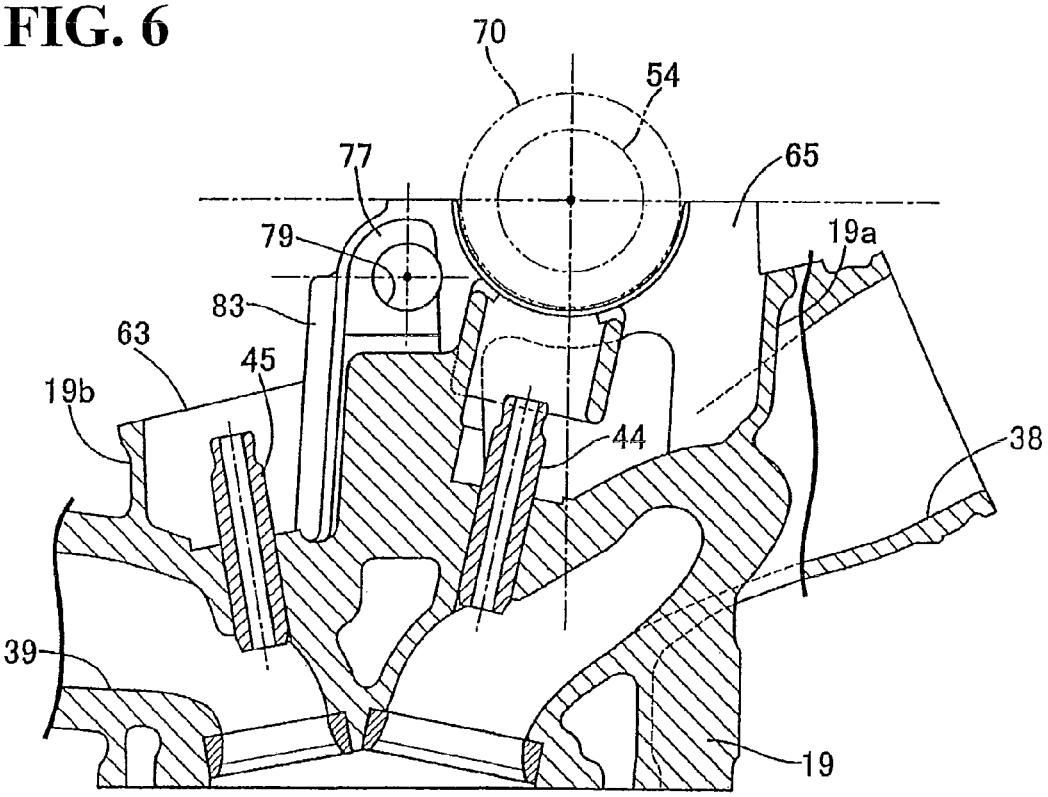
FIG. 6 is a cross-sectional view taken along line 6-6 of FIG. 4.
Figure 7:
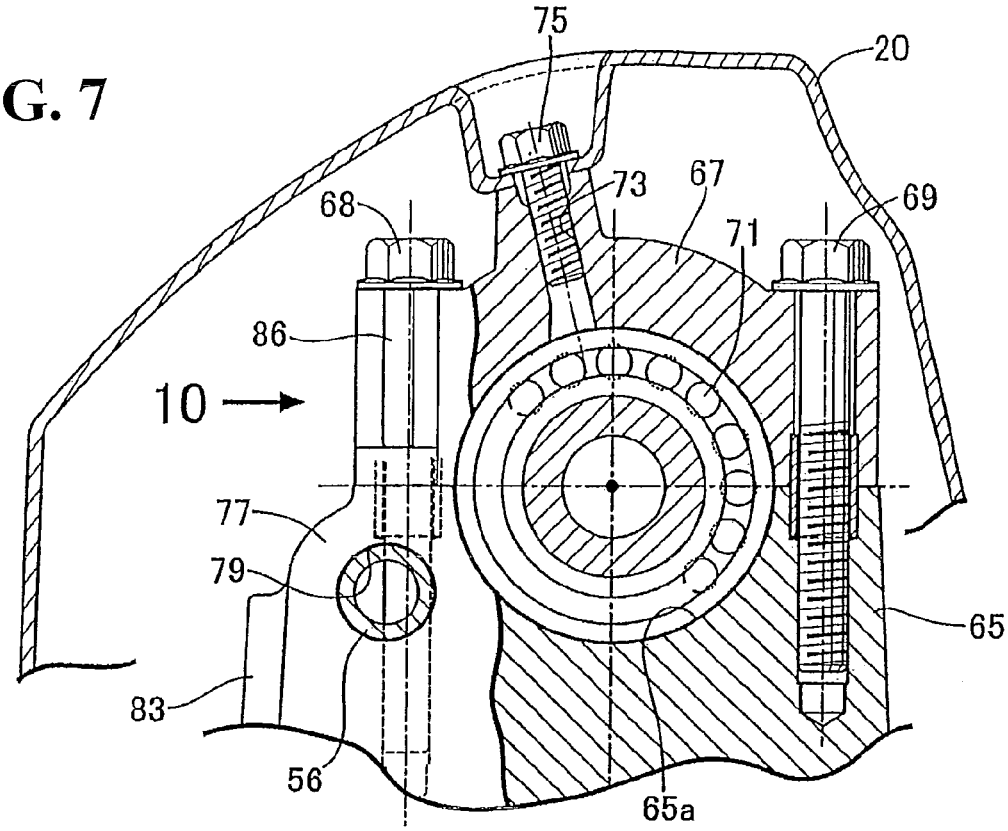
FIG. 7 is a cross-sectional view taken along line 7-7 of FIG. 3.

Referring also to FIGS. 6 and 7, the camshaft 54 is rotatably supported by a pair of camshaft holders 64, 65 and cam caps 66, 67. Specifically, the camshaft holders 64, 65 are integrated with the cylinder head 19 in a protruding condition at positions spaced apart from each other in the axial direction of the camshaft 54. The cam caps 66, 67 are fastened to the camshaft holders 64, 65, respectively, using each pair of bolts 68, 69 disposed on either side of the camshaft 54. Accordingly, the camshaft holders 64, 65 include semi-circular bearing portions 64*a*, 65*a* that receive a substantially half portion of the camshaft 54. The cam caps 66, 67 receiving a remainder substantially half portion of the camshaft 54 are fastened to the camshaft holders 64, 65 with each of the pair of bolts 68, 69 disposed on either side of the camshaft 54. Further, ball bearings 70, 71 are inserted between the camshaft holders 64, 65 and the cam caps 66, 67.

The cam caps 66, 67 include threaded holes 72, 73 formed therein, respectively. Bolts 75 that are passed through and engaged with the head cover 20 are threaded into the threaded holes 72, 73, respectively. Tightening the bolts 75 results in the head cover 20 being connected to the connection surface 63 of the cylinder head 19 via the gasket 62.

The camshaft holders 64, 65 are integrally connected to the first side wall 19*a* of the cylinder head 19. Further, the camshaft holders 64, 65 are integrated with the cylinder head 19 in a protruding condition so as to protrude from the connection surface 63 as viewed from the axial direction of the camshaft 54. The bearing portions 64*a*, 65*a* of the camshaft holders 64, 65 are disposed at a position protruding from the connection surface 63 as viewed from the axial direction of the camshaft 54.

The intake port 38 is disposed in the first side wall 19*a* such that an upstream end thereof is disposed at the same position as part of the bearing portions 64*a*, 65*a* of the camshaft holders 64, 65 in a direction along an axis C of the cylinder bore 35. Additionally, the intake port 38 has an upper end disposed upward of a lower end of the camshaft 54. Specifically, the upper end of the intake port 38 is disposed upward of a horizontal line L that passes through the lower end of the camshaft 54.

The rocker shaft 56 is supported by the cylinder head 19 by being disposed at a position protruding from the connection surface 63 as viewed from the axial direction of the camshaft 54. A pair of rocker shaft support portions 76, 77 supporting the rocker shaft 56 is integrated with the cylinder head 19 so as to be disposed between the exhaust valves 41 and the camshaft 54 as viewed from the axial direction of the camshaft 54 and the rocker shaft 56.

Figure 8:
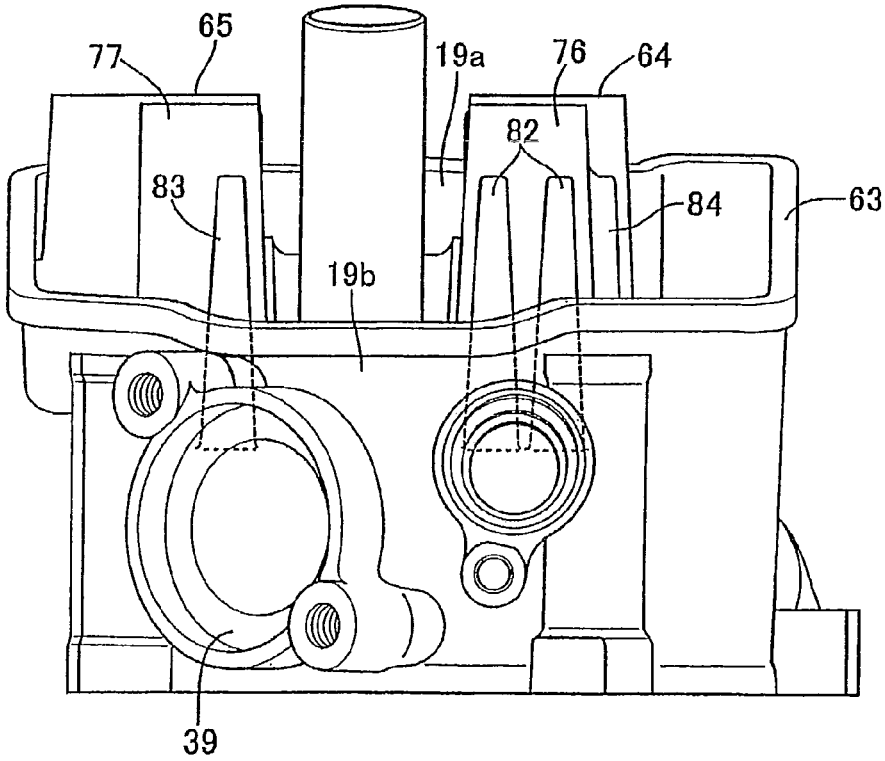
FIG. 8 is a view on arrow 8 of FIG. 4.
Figure 9:
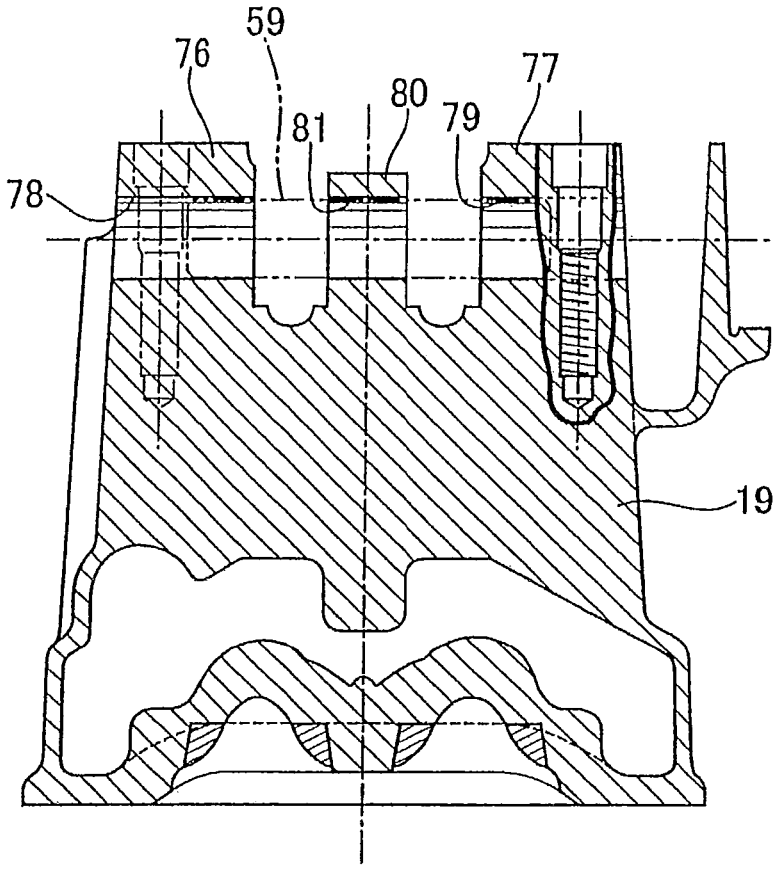
FIG. 9 is a cross-sectional view taken along line 9-9 of FIG. 4.

Referring also to FIGS. 8 and 9, the rocker shaft support portions 76, 77 are integrated continuously with the camshaft holders 64, 65 to rockably support both ends of the rocker shaft 56. The rocker shaft support portions 76, 77 include support holes 78, 79, respectively, formed therein coaxially therewith for supporting the rocker shaft 56. Of each pair of bolts 68, 69 for fastening the cam caps 66, 67 to the camshaft holders 64, 65, the bolts 68 engage with both ends of the rocker shaft 56 that is passed through the support holes 78, 79, thereby securing the rocker shaft 56 to the rocker shaft support portions 76, 77.

The rocker arm 57 is disposed between the rocker shaft support portions 76, 77. The cylinder head 19 includes a rocker shaft center support portion 80 integrally formed therewith between the rocker shaft support portions 76, 77. The rocker shaft center support portion 80 has a support hole 81 coaxial with the support holes 78, 79. The rocker shaft center support portion 80 supports the rocker shaft 56 at an axial central portion thereof.

The rocker shaft support portion 76 of the two rocker shaft support portions 76, 77 has a side face opposite the camshaft 54, on which a pair of first reinforcement ribs 82, 82 is disposed. The first reinforcement ribs 82, 82 are provided integrally on a plane that is orthogonal to the axis of the rocker shaft 56. The other rocker shaft support portion 77 has a side face opposite the camshaft 54, on which a first reinforcement rib 83 is disposed. The first reinforcement rib 83 is provided integrally on a plane that is orthogonal to the axis of the rocker shaft 56.

At least one of the two rocker shaft support portions 76, 77, specifically, the one rocker shaft support portion 76 according to the embodiment of the present invention has a side face opposite the rocker arm 57, on which a pair of second reinforcement ribs 84, 84 is disposed. The second reinforcement ribs 84, 84 are provided integrally on a plane that is in parallel with the axis of the rocker shaft 56.

Figure 10:
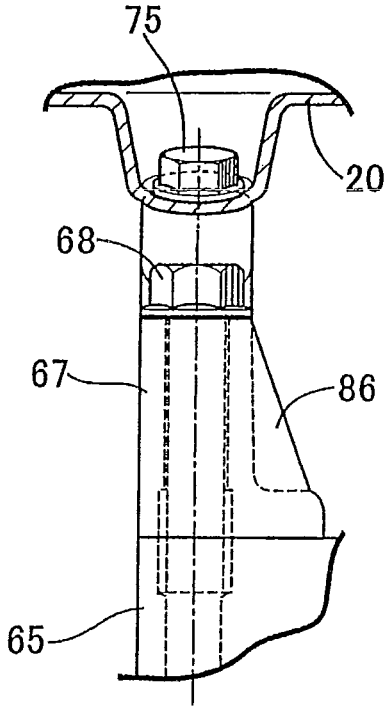
FIG. 10 is a view on arrow 10 of FIG. 7.

Referring also to FIG. 10, the cam caps 66, 67, which are fastened, respectively, to the camshaft holders 64, 65 include third reinforcement ribs 85, 86 formed integrally thereon in a protruding condition. The third reinforcement ribs 85, 86 protrude in a direction along the axis of the camshaft 54 from portions of the cam caps 66, 67 fastened to the camshaft holders 64, 65 by the bolts 68. The third reinforcement ribs 85, 86 abut on the rocker shaft support portions 76, 77, respectively.

Effects of the cylinder head structure according to the embodiment of the present invention will be described below. Specifically, the connection surface 63 formed on the cylinder head 19 for connecting the head cover 20 is set so as to follow along the plane inclined to be spaced further away from the cylinder block 18 toward the first side wall 19*a* relative to the second side wall 19*b*. The camshaft holders 64, 65 including the semi-circular bearing portions 64*a*, 65*a* that receive a substantially half portion of the camshaft 54 and the stem ends 43*a* of the exhaust valves 41 protrude from the connection surface 63 as viewed in the direction along the axis of the camshaft 54. The cylinder head 19 can therefore be further reduced in size and weight.

The intake port 38 is disposed in the first side wall 19*a* such that the upstream end thereof is disposed at the same position as part of the bearing portions 64*a*, 65*a* of the camshaft holders 64, 65 in the direction along the axis C of the cylinder bore 35. A flow direction in the intake port 38 is sharply inclined at a side close to the cylinder axis, thereby ensuring good introduction of fuel into the combustion chamber 37 for the enhanced engine performance in a low-to-medium speed range.

The camshaft holders 64, 65 are integrally connected with the first side wall 19*a* to be integrated with the cylinder head 19 in a protruding condition. Stiffness of the camshaft holders 64, 65 can therefore be enhanced such that the camshaft holders 64, 65 are reinforced with the first side wall 19*a*.

The valve actuating system 51 driving to open or close the exhaust valves 41 includes the rocker shaft 56 having the axis extending in parallel with the camshaft 54 and supported by the cylinder head 19 by being disposed at a position protruding from the connection surface 63 as viewed from the axial direction of the camshaft 54 and the rocker arm 57 rotatably supported by the rocker shaft 56 so as to rock by following rotation of the exhaust-side valve actuating cam 53 disposed on the camshaft 54. The stems 43 of the exhaust valves 41 driven to open or close by the rocker arm 57 are shorter in length than the stems 42 of the intake valves 40. This allows the exhaust valves 41 to be reduced in weight for the improved operating response of the exhaust valves 41 at a high speed range. The stem ends 43*a* of the exhaust valves 41 are disposed at positions protruding from the connection surface 63 despite the shorter length of the stems 43 of the exhaust valves 41. This allows a tappet clearance between the rocker arm 57 and the stem ends 43*a* to be checked easily.

Additionally, the bearing portions 64*a*, 65*a* of the camshaft holders 64, 65 are disposed at a position protruding from the connection surface 63 as viewed from the axial direction of the camshaft 54. Machinability of the bearing portions 64*a*, 65*a* can therefore be improved.

The rocker shaft support portions 76, 77 supporting the rocker shaft 56 are integrated with the cylinder head 19 so as to be disposed between the exhaust valves 41 and the camshaft 54 as viewed from the axial direction of the camshaft 54 and the rocker shaft 56. The first reinforcement ribs 82, 82, 83 are integrally disposed in a protruding condition on the plane that is orthogonal to the axis of the rocker shaft 56 on the side face of the rocker shaft support portions 76, 77 opposite the camshaft 54. This enhances stiffness of the rocker shaft support portions 76, 77, while avoiding an increase in size of the rocker shaft support portions 76, 77 and, for that matter, an increase in size of the cylinder head 19. This improves the operating response of the exhaust valves 41 . . . .

The pair of rocker shaft support portions 76, 77 that rockably support both ends of the rocker shaft 56 are integrated with the cylinder head 19 such that the rocker arm 57 is disposed between the rocker shaft support portions 76, 77. The second reinforcement ribs 84, 84 are integrally disposed in a protruding condition on the plane that is in parallel with the axis of the rocker shaft 56 on the side face opposite the rocker arm 57 of at least one of the two rocker shaft support portions 76, 77, specifically, the rocker shaft support portion 76. This allows the second reinforcement ribs 84 to prevent the rocker shaft support portion 76 from being tilted by a load acting on the rocker shaft 56 from the rocker arm 57 between the two rocker shaft support portions 76, 77. Stiffness of the rocker shaft support portion 76 can be enhanced with the structure that includes the second reinforcement ribs 84 integrated with the rocker shaft support portion 76 in a protruding condition to thereby avoid making the size larger.

The camshaft holders 64, 65 integrally connected to the rocker shaft support portions 76, 77 are integrated with the cylinder head 19. The cam caps 66, 67 that cooperate with the camshaft holders 64, 65 to rotatably support the camshaft 54 are fastened to the camshaft holders 64, 65. The third reinforcement ribs 85, 86 that protrude in the direction along the axis of the camshaft 54 from the portions of the cam caps 66, 67 fastened to the camshaft holders 64, 65 are integrated with the cam caps 66, 67 in a protruding condition and abut on the rocker shaft support portions 76, 77, respectively. The rocker shaft support portions 76, 77 can therefore be further reinforced with the third reinforcement ribs 85, 86. Stiffness of the rocker shaft support portions 76, 77 can be further enhanced, so that the operating response of the engine valves can be further enhanced.

The rocker shaft center support portion 80 that supports the rocker shaft 56 at the axial central portion thereof is integrated with the cylinder head 19 between the rocker shaft support portions 76, 77. This prevents the rocker shaft 56 from being flexed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cylinder head structure in a four-cycle engine, comprising:

a cylinder block having a cylinder bore in which a piston can be slidably fitted;

a cylinder head connected to the cylinder block, the cylinder head forming a combustion chamber that faces a top of the piston in a space defined by the cylinder head and the cylinder block;

a camshaft disposed on an extension of an open/close operation axis of an intake valve, the camshaft forming part of a valve actuating system driving to open and close the intake valve and an exhaust valve openably disposed in the cylinder head;

an intake port disposed in a first side wall extending along an axis of the camshaft so as to be disposed in the cylinder head;

an exhaust port disposed in a second side wall disposed in the cylinder head so as to oppose the first side wall; and a head cover forming a valve train chamber that accommodates therein the valve actuating system in a space defined by the head cover and the cylinder head, a connection surface formed in the cylinder head for connecting the head cover being extended to follow along a plane that is inclined so as to be spaced further away from the cylinder block toward the first side wall relative to the second side wall, wherein:

camshaft holders having semi-circular bearing portions that generally receive a half portion of the camshaft to be integrally connected to the first side wall are integrated with the cylinder head and the semi-circular bearing portions protrude above the entire connection surface as viewed from an axial direction of the camshaft;

cam caps are respectively fastened to the camshaft holders and receive a remainder substantially half portion of the camshaft;

bolts pass through the head cover and are respectively threaded into the cam caps such that the head cover is in direct contact with the cam caps, and at least one of the bolts extends along a plane that obliquely crosses a cylinder axis;

the intake port is disposed in the first side wall; and a stem end of the exhaust valve is disposed at a position protruding above the connection surface as viewed in a direction along the axis of the camshaft, wherein the intake port has an upper end disposed upward of a lower end of the camshaft, and wherein a stem of the intake valve driven to open or close by valve lifters is longer in length than the stem of the exhaust valve.

2. The cylinder head structure according to claim 1, wherein the valve actuating system further comprises:

a rocker shaft having an axis extending in parallel with the camshaft and supported by the cylinder head by being disposed at a position protruding from the connection surface as viewed from the axial direction of the camshaft; and a rocker arm rotatably supported by the rocker shaft so as to rockably follow rotation of an exhaust-side valve actuating cam disposed on the camshaft.

3. The cylinder head structure according to claim 1, wherein the bearing portions of the camshaft holders are disposed at positions protruding from the connection surface as viewed from the axial direction of the camshaft.

4. The cylinder head structure according to claim 2, wherein the bearing portions of the camshaft holders are disposed at positions protruding from the connection surface as viewed from the axial direction of the camshaft.

5. The cylinder head structure according to claim 1, wherein an upper end of the intake port is disposed upward of a horizontal line that passes through a lower end of the camshaft.

6. The cylinder head structure according to claim 2, wherein a pair of rocker shaft support portions supporting the rocker shaft is integrated with the cylinder head so as to be disposed between the exhaust valves and the camshaft as viewed from the axial direction of the camshaft and the rocker shaft.

7. The cylinder head structure according to claim 6, wherein one of the pair of rocker shaft support portions has a side face opposite the camshaft, on which a pair of first reinforcement ribs is disposed, reinforcement ribs are provided integrally on a plane that is orthogonal to an axis of the rocker shaft, the other of the pair of rocker shaft support portions has a side face opposite the camshaft, on which a reinforcement rib is disposed, the reinforcement rib is provided integrally on a plane that is orthogonal to the axis of the rocker shaft.

8. A cylinder head structure for a four-cycle engine, comprising:

a cylinder head;

a camshaft disposed on an extension of an open/close operation axis of an intake valve, the camshaft forming part of a valve actuating system driving to open and close the intake valve and an exhaust valve openably disposed in the cylinder head;

an intake port disposed in a first side wall extending along an axis of the camshaft so as to be disposed in the cylinder head; and an exhaust port disposed in a second side wall disposed in the cylinder head so as to oppose the first side wall, wherein a connection surface formed in the cylinder head for connecting a head cover is inclined, so that a side of the connection surface on the intake port side is further from a junction between the cylinder head and cylinder block than an exhaust port side of the connection surface, wherein a stem end of the exhaust valve is disposed at a position protruding above the connection surface as viewed in a direction along the axis of the camshaft, wherein camshaft holders having semi-circular bearing portions that generally receive a half portion of the camshaft to be integrally connected to the first side wall are integrated with the cylinder head and the semi-circular bearing portions protrude above the entire connection surface as viewed from an axial direction of the camshaft, wherein cam caps are respectively fastened to the camshaft holders and receive a remainder substantially half portion of the camshaft, wherein bolts pass through the head cover and are respectively threaded into the cam caps such that the head cover is in direct contact with the cam caps, and at least one of the bolts extends along a plane that obliquely crosses a cylinder axis, wherein the intake port has an upper end disposed upward of a lower end of the camshaft, and wherein a stem of the intake valve driven to open or close by valve lifters is longer in length than the stem of the exhaust valve.

9. The cylinder head structure according to claim 8, wherein the intake port is disposed in the first side wall.

10. The cylinder head structure according to claim 8, wherein the valve actuating system further comprises:

a rocker shaft having an axis extending in parallel with the camshaft and supported by the cylinder head by being disposed at a position protruding from the connection surface as viewed from the axial direction of the camshaft; and a rocker arm rotatably supported by the rocker shaft so as to rockably follow rotation of an exhaust-side valve actuating cam disposed on the camshaft.

11. The cylinder head structure according to claim 8, wherein the bearing portions of the camshaft holders are disposed at positions protruding from the connection surface as viewed from the axial direction of the camshaft.

12. The cylinder head structure according to claim 8, wherein the bearing portions of the camshaft holders are disposed at positions protruding from the connection surface as viewed from the axial direction of the camshaft.

13. The cylinder head structure according to claim 8, wherein an upper end of the intake port is disposed upward of a horizontal line that passes through a lower end of the camshaft.

14. The cylinder head structure according to claim 10, wherein a pair of rocker shaft support portions supporting the rocker shaft is integrated with the cylinder head so as to be disposed between the exhaust valves and the camshaft as viewed from the axial direction of the camshaft and the rocker shaft.

15. The cylinder head structure according to claim 14, wherein one of the pair of rocker shaft support portions has a side face opposite the camshaft, on which a pair of first reinforcement ribs is disposed, reinforcement ribs are provided integrally on a plane that is orthogonal to an axis of the rocker shaft, the other of the pair of rocker shaft support portions has a side face opposite the camshaft, on which a reinforcement rib is disposed, the reinforcement rib is provided integrally on a plane that is orthogonal to the axis of the rocker shaft.

* * * * *